US005753896A

United States Patent [19]

Rufolo

[11] Patent Number: 5,753,896

[45] Date of Patent: May 19, 1998

[54] ACID-BASE EQUILIBRIUM SLIDE-RULE

[76] Inventor: Lucio Rufolo, Via San Domenico, 29, I-80126 Napoli, Italy

[21] Appl. No.: 714,074

[22] PCT Filed: Mar. 21, 1995

[86] PCT No.: PCT/EP95/01057

§ 371 Date: Dec. 6, 1996

§ 102(e) Date: Dec. 6, 1996

[87] PCT Pub. No.: WO95/25993

PCT Pub. Date: Sep. 28, 1995

[30] Foreign Application Priority Data

Mar. 21, 1994 [IT] Italy ..... NA94A0010

[51] Int. Cl.[6] ..... G06G 1/02

[52] U.S. Cl. ..... 235/70 A

[58] Field of Search ..... 235/70 R, 70 A, 235/89 R, 61, 69

[56] References Cited

U.S. PATENT DOCUMENTS

| | | | |
|---|---|---|---|
| 4,023,276 | 5/1977 | Furukawa et al. . | |
| 4,327,584 | 5/1982 | Alinari | 73/300 |
| 4,775,779 | 10/1988 | Fukute | 235/70 R |
| 4,960,029 | 10/1990 | Nelson | 235/70 R |
| 4,961,362 | 10/1990 | Gunn | 84/474 |
| 5,280,567 | 1/1994 | Kobayashi | 395/118 |

FOREIGN PATENT DOCUMENTS

| | | |
|---|---|---|
| 2304122 | 10/1976 | France . |
| 2384304 | 10/1978 | France . |
| 2530360 | 1/1984 | France . |
| 2604891 | 4/1988 | France . |

OTHER PUBLICATIONS

Patent Abstracts of Japan, vol. 16, No. 365 (P-1397), 6 Aug. 1992, Pat. 4,111,266 14 Apr. 1992, Takeshi.

*Primary Examiner*—Edward Tso

*Attorney, Agent, or Firm*—Levine & Mandelbaum

[57] ABSTRACT

A slide rule for ascertaining the state of acid-base equilibrium has three slides moveable within a frame, each with visible scales on one side for entering the respective three haemogasanalytical parameters, pH, $PaCO_2$ and $HCO_3$Indicia, including symbols and colors on the rear sides of the slides, are visible through windows on the rear of the frame for indicating the state of acid-base equilibrium.

6 Claims, 3 Drawing Sheets

ACID-BASE EQUILIBRIUM SLIDE-RULE

BACKGROUND OF THE INVENTION

The state of the acid-base equilibrium (E.A.B.) is information which is of great importance in medicine, inasmuch E.A.B. alterations, if not rapidly and appropriately corrected, can result in being lethal for the patient. At the actual moment in time, in literature and in common use, only complicated alignment charts exist which permit the more experienced doctors to find directions in the diagnostic sense within such a complicated chapter of physiopathology such as E.A.B. As is known, the haemogasanalytical parameters necessary for the definition of the state of E.A.B. are essentially three: pH, partial pressure of carbon dioxide ($PaCO_2$) and bicarbonate ion ($HCO_3$).

Known from Patent Abstract of Japan vol. 16 no. 365 (P-1397), & JP-A-41013266 is the use of alignment charts for indicating and determining the state of the acid-base equilibrium. Such alignment charts however are of very difficult use.

Known from FR-A-2384304 is a device permitting the calculation of three haematological constants starting from three measures, comprising three independent sliding scales having three indexes indicating the constants.

Known from U.S. Pat. No. 4,023,276 is a diagnostic scale for interpretation of an electrocardiogram, composed of a fixed diagnostic scale having two sections, one displaying the interrogation items and another the diagnostic names of the electrocardiogram; and comprising a plurality of sliding scales each indicating the affirmation or denial of the interrogation items; by arranging the diagnostic scales according to the affirmation or denial to each interrogation item, diagnostic names can be displayed on the fixed diagnostic scale.

The diagnostic scale described in said U.S. application is quite complicated and difficult to use.

In the attached table:

FIG. 1 shows the front side of the slide-rule and the front face of the three cursors;

FIG. 2 shows the rear face of the three cursors;

FIG. 3 shows the back side of the slide rule.

SUMMARY OF THE INVENTION

With the acid-base equilibrium slide-rule the sate of E.A.B. is made possible from the knowledge of numerical values of the said three parameters obtained by way of a normal haemogasanalytical exam. The E.A.B. slide-rule consists, in fact, of three cursors, on which according to a graded scale the numerical values of the pH, the ion $HCO_3$ and of the $PaCO_2$ are indicated. More precisely the E.A.B. slide-rule consists of an outer frame, within which the three cursors slide, which has a frontal face or frontal rule and a rear face or rear-rule. The frontal-rule is made up of a transparent material that covers the front of the outer frame within which the three cursors slide, allowing in such way a perfect vision of the frontal face of the actual cursors.

DESCRIPTION OF THE PREFERRED EMBODIMENT

Figure 1:
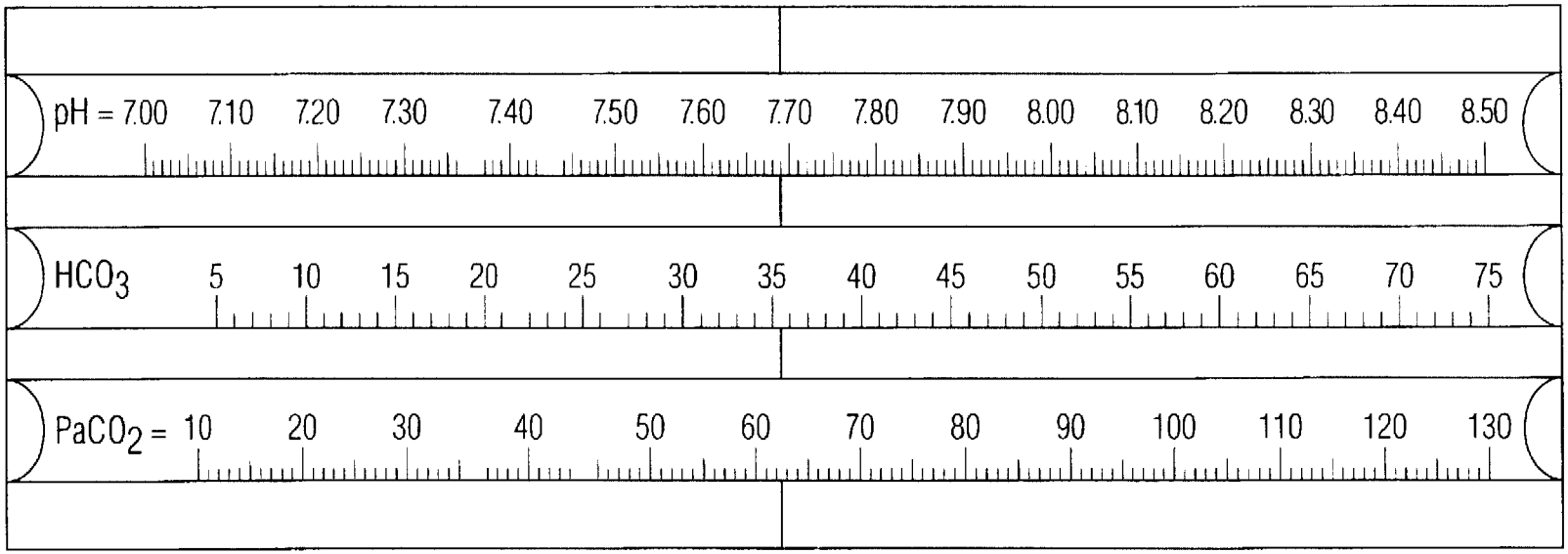
FIG. 1 is a front elevation view of the preferred embodiment of the invention.
Figure 2:
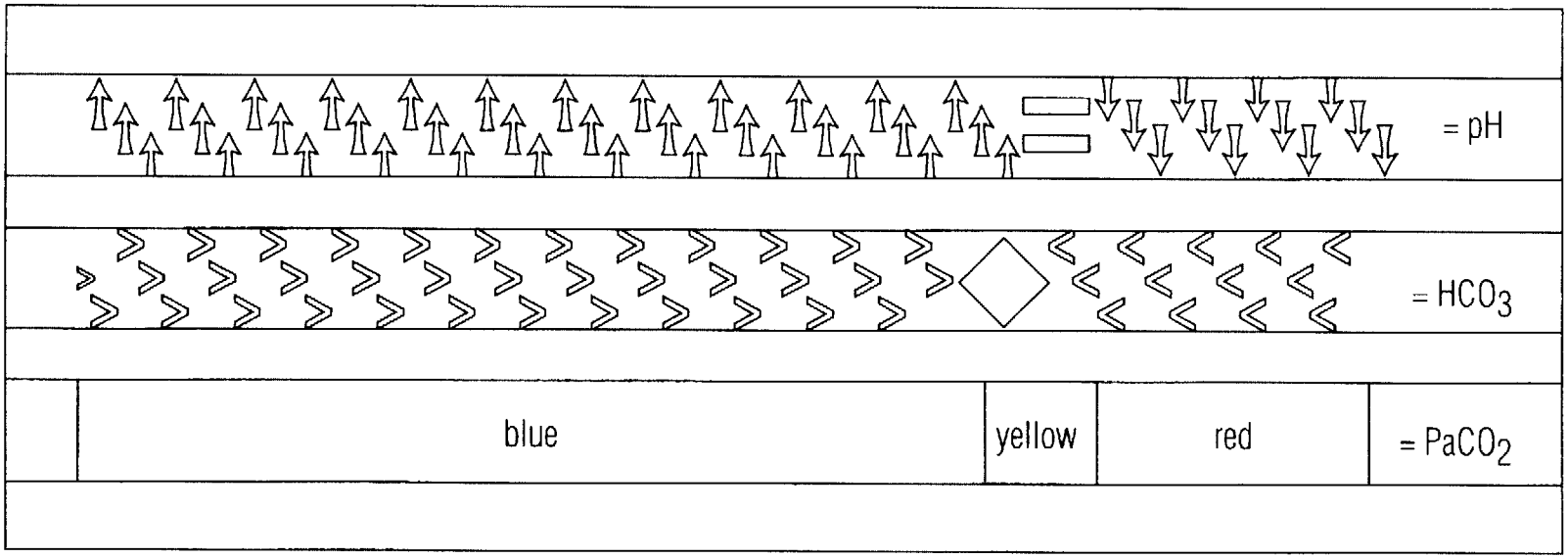
FIG. 2 is a rear elevation view of parts of the preferred embodiment of the invention shown in FIG. 1.

As is illustrated in FIG. 1 such frontal-rule of a transparent material has, at the height of each cursor and in correspondence with each extremity of the same, a semicircular cut that allows for holding the cursor between two fingers for its movement within the groove towards the right or the left. On the frontal-rule (FIG. 1) the frontal faces of the three cursors, by way of the aforementioned transparent material, are therefore made visible, so that from the from the top towards the bottom they are contained in corresponding grooves according to the order: pH, $HCO_3$, $PaCO_2$. The pH scale varies from a numerical value of 7.00 to one of 8.50 according to a centesimal subdivision corresponding to 7.00-7.10-7.20-7.30-7.40-7.50-7.60-7.70-7.80-7.90-8.00-8.10-8.20-8.30-8.40-8.50. The second cursor is that of the ion $HCO_3$: the graded scale varies from 5 to 75 according to a unitary subdivision (5,6,7,etc.). The numerical subdivisions corresponding to 5, 10, 15, 20, 25, 30, 35, 40, 45, 50, 55, 60, 65, 70 and 75 are indicated. The third cursor is that of the $PaCO_2$: The graded scale varies from a numerical value of 10 to one of 130 according to a unitary subdivision (10, 11, 12, etc.). The numerical subdivision corresponding to 10, 20, 30, 40, 50, 60, 70, 80, 90, 100, 110, 120 and 130 are indicated. The outer frame, within which the three cursors slide, can be of any material: it is important that, as illustrated in FIG. 1 of the drawings, in correspondence to the centre of the slide-rule, four line segments are marked being perpendicularly perfect and in line one with the other. This allows for, once the numerical values by way of arterial haemogasanalysis of the three aforementioned cursors are known, sliding the three cursors in one of the two senses (i.e. left or right, and each cursor independently from the other two) so as to have the three numerical values of the pH, $HCO_3$ and $PaCO_2$ perfectly aligned one above the other in correspondence with the segments of the median line. FIG. 2 illustrates the rear faces of the three aforementioned cursors. The pH numerical values comprising 7.37 and 7.43 (that constitute the normal range) are indicated on the rear of the cursor by the symbol =. Values being equal to or lower than 7.36 to 7.00 are indicated on the rear of the cursor (right hand side of FIG. 2) by downward pointing arrows. Vice-versa, numerical values being equal to or higher than 7.44 to 8.50 are indicated on the rear of the cursor (left hand side of FIG. 2) by upward pointing arrows. Concerning the cursor of the ion $HCO_3$, the numerical values from 22 to 26, which correspond to the normal range, on the rear of the cursor, as indicated in FIG. 2 of the enclosed table 1, correspond to a black diamond. $HCO_3$ numerical values being equal to or lower than 21 correspond on the rear of the cursor (right hand side of FIG. 2) to the symbol <. For $HCO_3$ numerical values being equal to or higher than 26 on the rear of the cursor (left hand side of FIG. 2) correspond to the symbol >. Concerning the $PaCO_2$, numerical values comprising 36 to 44, which is the normal range, correspond on the rear of the cursor (FIG. 2) to the colour yellow.

Figure 3:
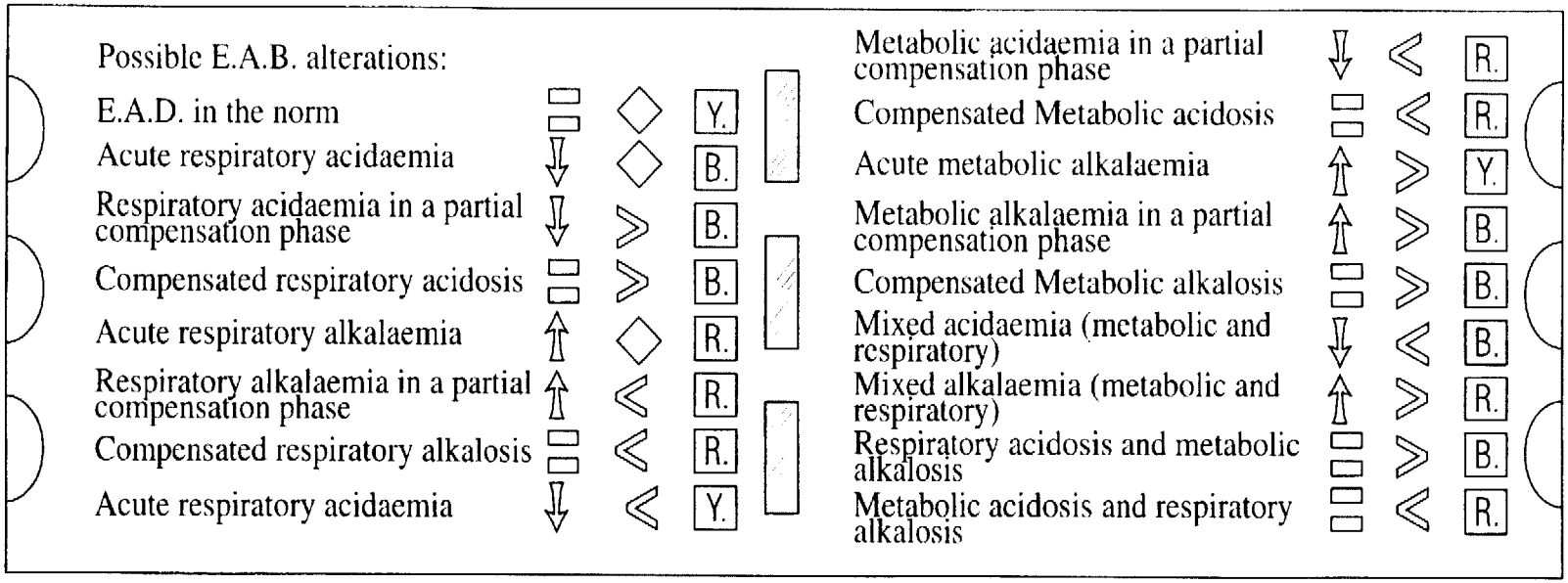
FIG. 3 is a rear elevation view of another part of the preferred embodiment of the invention shown in FIG. 1.

As it is not possible to use colours in the drawings, in the corresponding area of FIG. 2 the work yellow is used. For $PaCO_2$, numerical values being equal to or lower than 35 to 10 correspond on the rear of the cursor (right hand side of FIG. 2) to the color red. Due to the impossibility of using colours in the table drawings, in the corresponding area of FIG. 2 the word red is used. For $PaCO_2$, numerical values being equal to or higher than 45 to 130 correspond on the rear of the cursor (left hand side of FIG. 2) to the color blue. As it is not possible to use colours in the drawings, in the corresponding area of FIG. 2 the word blue is used. FIG. 3 corresponds to the rear face of the slide-rule or rear-rule, that is applied to the rear of the outer frame within which the three cursors slide. It has at the height of each cursor (pH, $HCO_3$ and $PaCO_2$) and in correspondence with each extremity of the same, a semicircular cut that allows for holding the cursor between two fingers for its movement within the grooves towards the right or the left. Moreover, the rear face of the slide-rule has, as illustrated in FIG. 3, in the central area, three windows arranged one above the other in a perpendicular sense. In such three windows the symbols and colors appear that correspond respectively, proceeding from the top to the bottom, to the numerical values of the pH, $HCO_3$ and $PaCO_2$. Therefore, according to the numerical values of such three parameters, which are expressed on the rear face of the slide-rule according to the indications just described, in the windows of the rear face of the slide-rule appear the respective symbols and colors. The three colors (yellow, red and blue) are fundamental, as are the symbols, in diagnosing the state of the E.A.B. Therefore, as in FIG. 3 it is not possible to use colours in the key notes represented on the rear face of the slide-rule, in the squares of the possible combinations within which colors should be present said color is indicated with a letter: G. stands for yellow, B. stands for blue, R. stands for red. As it is possible to see from FIG. 3, on the rear face of the slide-rule all the possible combinations of symbols and colours are indicated, corresponding to the state of equilibrium of acid-base that may be found in numerous clinical situations. Therefore, the rear-rule allows for the display of the symbols and colours that appear in the three central windows and to compare these combinations with those indicated in the key notes, in which every possible combination corresponds to a different state of E.A.B. From the combinations of the symbols and colours corresponding to the numerical values of the pH, $HCO_3$ and $PaCO_2$ the following conditions, as indicated in the key notes of FIG. 3 of the enclosed table 1, are possible: EAB IN THE NORM - ACUTE RESPIRATORY ACIDAEMIA - RESPIRATORY ACIDAEMIA IN A PARTIAL COMPENSATION PHASE - COMPENSATED RESPIRATORY ACIDOSIS - ACUTE RESPIRATORY ALKALAEMIA - RESPIRATORY ALKALAEMIA IN A PARTIAL COMPENSATION PHASE - COMPENSATED RESPIRATORY ALKALOSIS - ACUTE METABOLIC ACIDAEMIA - METABOLIC ACIDAEMIA IN A PARTIAL COMPENSATION PHASE - COMPENSATED METABOLIC ACIDOSIS - ACUTE METABOLIC ALKALEAMIA - METABOLIC ALKALAEMIA IN A PARTIAL COMPENSATION PHASE - COMPENSATED METABOLIC ALKALOSIS - MIXED ACIDAEMIA (METABOLIC AND RESPIRATORY) - MIXED ALKALAEMIA (METABOLIC AND RESPIRATORY) - RESPIRATORY ACIDOSIS AND METABOLIC ALKALOSIS - METABOLIC ACIDOSIS AND RESPIRATORY ALKALOSIS. Finally, a very important advantage of the described slide-rule of E.A.B. is its great level of practical use. In fact, from the dimensions of the figures it should be understood that the dimensions of the slide-rule, in full respect of perfect readability, are such as to allow its easy access in a pocket of a medical overall. It is therefore of simple use, of perfect readability and of great practical use in relation to its dimensions.

I claim:

1. Slide rule of acid-base equilibrium, comprising an outer frame within which three cursors slide, on a first face of which the numerical values of the pH, ion $HCO_3$ and $PaCO_2$ are indicated according to a graded scale, while on the second face of each of the side cursors a number of three different symbols and/or colours are indicated; the outer frame has on a first face three indexes and on a second three windows; the grades scales, indexes, symbols/colours and windows are arranged such that when moving the cursors so as that in the first face of the slide-rule, in correspondence of said indexes, the values of the pH, ion $HCO_3$ and $PaCO_2$ are readable, through said windows a combination of three of said symbols and/or colours is visible; on the second face of the slide-rule there is a table showing a series of combinations, each of three symbols, one of the first cursor, one of the second cursor and one of the third cursor, and in correspondence of every combination, the relative diagnosis is indicated.

2. Slide-rule of acid-base equilibrium, according to claim 1, characterized in that on the second face of the pH cursor a series of upward pointing arrows, one or more equal signs (=), a series of downward pointing arrows are indicated.

3. Slide-rule of acid-base equilibrium, according to claim 1, characterized in that on the second face of the ion $HCO_3$ cursor a series of less than symbols (<), one or more diamonds, a series of greater than symbols (>) are indicated.

4. Slide-rule of acid-base equilibrium, according to claim 1, characterized in the on the second face of the $PaCO_2$ cursor a blue colour zone, a yellow colour zone and a red colour appear.

5. Slide-rule of acid-base equilibrium, according to claim 1, characterized in that the frontal face of the outer frame of the slide-rule is made of a transparent material that covers the sliding cursors.

6. Slide-rule of acid-base equilibrium, according to claim 1, characterized in that the frontal face of said outer frame of the slide-rule has on its sides, at the height of each cursor and in correspondence of the extremities of the same, a semicircular cut which allows for holding the cursor between two fingers and to carry out a movement of the same towards the left or right within the outer frame.

* * * * *